US007513305B2

(12) United States Patent
Wilson et al.

(10) Patent No.: US 7,513,305 B2
(45) Date of Patent: Apr. 7, 2009

(54) APPARATUS AND METHODS FOR OPERATING A TOOL IN A WELLBORE

(75) Inventors: Paul Wilson, Houston, TX (US); David M. Haugen, League City, TX (US); Frederick T. Tilton, Spring, TX (US); John Douglas Roberts, Spring, TX (US); Ronald B. Collins, Edmonton (CA); John David, Houston, TX (US); David Nuth, Calgary (CA); David G. Hosie, Sugar Land, TX (US); Ronald E. Bothner, The Woodlands, TX (US); Michael Nero, Houston, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 422 days.

(21) Appl. No.: 11/026,963

(22) Filed: Dec. 30, 2004

(65) Prior Publication Data

US 2005/0269106 A1 Dec. 8, 2005

Related U.S. Application Data

(63) Continuation-in-part of application No. 10/127,021, filed on Apr. 19, 2002, now Pat. No. 6,915,849, application No. 11/026,963, which is a continuation-in-part of application No. 10/999,818, filed on Nov. 30, 2004, now abandoned, and a continuation-in-part of application No. 10/867,389, filed on Jun. 14, 2004, now Pat. No. 7,185,700, and a continuation-in-part of application No. 10/848,337, filed on May 18, 2004, now Pat. No. 7,000,692, and a continuation-in-part of application No. 10/068,555, filed on Feb. 6, 2002, now abandoned.

(60) Provisional application No. 60/285,891, filed on Apr. 23, 2001.

(51) Int. Cl.
*E21B 17/20* (2006.01)

(52) U.S. Cl. ..... 166/254.2; 166/77.1; 166/77.2; 166/242.2; 166/384; 166/385

(58) Field of Classification Search ..... 166/254.2, 166/77.1, 242.2, 255.1, 384, 385, 77.2
See application file for complete search history.

(56) References Cited

U.S. PATENT DOCUMENTS 2,379,800 A 7/1945 Hare (Continued)

FOREIGN PATENT DOCUMENTS

CA 2 335 192 11/2001

(Continued)

OTHER PUBLICATIONS

The Shale-Compensated Chlorine Log, (SPE4511), P.F. McKinlay and H.L. Tanner, presented at SPE-AIME 1974.

(Continued)

*Primary Examiner*—Hoang Dang
(74) *Attorney, Agent, or Firm*—Patterson & Sheridan, LLP

(57) ABSTRACT

The present invention generally relates to an apparatus and a method for conveying and operating tools into a wellbore. In one aspect, a method of performing a downhole operation in a wellbore is provided. The method includes pushing a continuous rod into the wellbore, wherein the continuous rod includes a member disposed therein. The method further includes positioning the continuous rod proximate at a predetermined location in the wellbore and performing the downhole operation. In yet another aspect, a system for performing a downhole operation in a wellbore is provided.

35 Claims, 8 Drawing Sheets

U.S. PATENT DOCUMENTS 2,414,719 A 1/1947 Cloud
2,469,461 A 5/1949 Russell
2,469,463 A 5/1949 Russell
2,470,743 A 5/1949 Hochgesang et al.
2,508,722 A 5/1950 Loesser
2,659,014 A 10/1953 Scherbatskoy
2,782,318 A 2/1957 Herzog
2,862,106 A 11/1958 Scherbatskoy
2,910,591 A 10/1959 Baker
2,933,609 A 4/1960 Norelius
2,949,535 A 8/1960 Scherbatskoy
2,993,994 A 7/1961 Herzog
3,071,687 A 1/1963 Youmans
3,090,031 A 5/1963 Lord
3,090,867 A 5/1963 Swanson et al.
3,121,164 A 2/1964 Swift
3,147,378 A 9/1964 Hall, Jr.
3,151,242 A 9/1964 Hall, Jr.
3,219,820 A 11/1965 Hall, Jr.
3,240,937 A 3/1966 McKay et al.
3,240,938 A 3/1966 Hall, Jr.
3,244,880 A 4/1966 Owen
3,247,377 A 4/1966 Hall, Jr.
3,265,893 A 8/1966 Rabson et al.
3,413,472 A 11/1968 Caldwell
3,439,165 A 4/1969 Hopkinson et al.
3,461,291 A 8/1969 Goodman
3,490,280 A 1/1970 Fields
3,532,884 A 10/1970 Dewan
3,559,905 A 2/1971 Palynchuk
3,564,248 A 2/1971 Hopkinson et al.
3,566,682 A 3/1971 Winkler, Jr.
3,611,799 A 10/1971 Davis
3,696,332 A 10/1972 Dickson, Jr. et al.
3,755,782 A 8/1973 Haas et al.
3,772,513 A 11/1973 Hall, Jr. et al.
3,780,301 A 12/1973 Smith, Jr. et al.
3,831,138 A 8/1974 Rammner
3,930,153 A 12/1975 Scott
3,988,581 A 10/1976 Peelman et al.
4,002,903 A 1/1977 Pitts, Jr. et al.
4,024,913 A * 5/1977 Grable ..... 166/72
4,066,892 A 1/1978 Givens
4,095,865 A 6/1978 Denison et al.
4,226,116 A 10/1980 Denison
4,320,800 A 3/1982 Upchurch
4,327,290 A 4/1982 Plasek
4,355,310 A 10/1982 Belaigues et al.
4,404,467 A 9/1983 Schweitzer et al.
4,445,734 A 5/1984 Cunningham
4,457,370 A 7/1984 Wittrisch
4,459,480 A 7/1984 Dimon
4,460,038 A 7/1984 Clamens
4,490,788 A 12/1984 Rasmussen
4,510,797 A 4/1985 Guidry et al.
4,566,318 A 1/1986 Rao et al.
4,570,480 A 2/1986 Fontenot et al.
4,580,632 A 4/1986 Reardon
4,585,939 A 4/1986 Arnold et al.
4,605,268 A 8/1986 Meador
4,628,202 A 12/1986 Minette
4,645,926 A 2/1987 Randall
4,656,354 A 4/1987 Randall
4,682,657 A 7/1987 Crawford
4,721,853 A 1/1988 Wraight
4,788,544 A 11/1988 Howard
4,790,378 A 12/1988 Montgomery et al.
4,794,336 A 12/1988 Marlow et al.
4,794,791 A 1/1989 Wittrisch
4,806,928 A 2/1989 Veneruso
4,833,320 A 5/1989 Hurlbut
4,883,956 A 11/1989 Melcher et al.
4,898,236 A 2/1990 Sask
4,901,069 A 2/1990 Veneruso
4,918,314 A 4/1990 Sonne
4,996,017 A 2/1991 Ethridge
5,010,764 A 4/1991 Taylor
5,019,978 A 5/1991 Howard, Jr. et al.
5,042,297 A 8/1991 Lessi
5,053,620 A 10/1991 McKeon et al.
5,080,175 A 1/1992 Williams
5,081,351 A 1/1992 Roscoe et al.
5,097,123 A 3/1992 Grau et al.
5,172,765 A 12/1992 Sas-Jaworsky et al.
5,184,682 A * 2/1993 Delacour et al. ..... 166/385
5,217,075 A 6/1993 Wittrisch
5,234,058 A 8/1993 Sas-Jaworsky et al.
5,279,366 A 1/1994 Scholes
5,348,097 A 9/1994 Giannesini et al.
5,351,531 A 10/1994 Kerr
5,394,141 A 2/1995 Soutier
5,410,152 A 4/1995 Gadeken
5,488,989 A 2/1996 Leising et al.
5,505,259 A 4/1996 Wittrisch et al.
5,530,359 A 6/1996 Habashy et al.
5,581,024 A 12/1996 Meyer, Jr. et al.
5,585,726 A 12/1996 Chau
5,608,214 A 3/1997 Baron et al.
5,608,215 A 3/1997 Evans
5,635,631 A 6/1997 Yesudas et al.
5,636,686 A 6/1997 Wittrisch
5,740,864 A 4/1998 de Hoedt et al.
5,749,417 A 5/1998 Delatorre
5,753,813 A 5/1998 Hagiwara
5,799,733 A 9/1998 Ringgenberg et al.
5,829,520 A 11/1998 Johnson
5,945,923 A 8/1999 Soutier
5,947,213 A 9/1999 Angle et al.
6,014,860 A 1/2000 Schenk et al.
6,101,445 A 8/2000 Alvarado et al.
6,114,972 A 9/2000 Smith
6,157,761 A 12/2000 Wittrisch
6,173,773 B1 1/2001 Almaguer et al.
6,173,787 B1 1/2001 Wittrisch
6,177,882 B1 1/2001 Ringgenberg et al.
6,179,058 B1 1/2001 Wittrisch
6,218,959 B1 4/2001 Smith
6,247,542 B1 6/2001 Kruspe et al.
6,318,463 B1 11/2001 Fehrmann et al.
6,459,263 B2 10/2002 Hawkes et al.
6,516,663 B2 2/2003 Wong
6,520,264 B1 2/2003 MacKenzie et al.
6,575,241 B2 6/2003 Widney et al.
6,649,906 B2 11/2003 Adolph et al.
6,703,606 B2 3/2004 Adolph
6,736,210 B2 5/2004 Hosie et al.
6,857,452 B2 * 2/2005 Quigley et al. ..... 138/125
2002/0170711 A1 11/2002 Nuth
2003/0070842 A1 4/2003 Bailey et al.
2003/0090390 A1 5/2003 Snider et al.
2003/0156494 A1 8/2003 McDaniel et al.
2004/0146133 A1 7/2004 Leung et al.

FOREIGN PATENT DOCUMENTS

EP 0 389 345 9/1990
EP 0 685 628 12/1995
EP 0 930 518 7/1999
EP 0 952 302 10/1999
EP 0 987 401 3/2000
FR 2 621 072 9/1987
FR 2 652 160 3/1991
GB 1 595 449 8/1981
GB 2 283 035 4/1995

| | | |
|---|---|---|
| GB | 2 284 625 | 6/1995 |
| GB | 2 346 189 | 8/2000 |
| WO | WO 00/30299 | 5/2000 |
| WO | WO 01/65066 | 9/2001 |

OTHER PUBLICATIONS

J.M. Deimel and D.G. Andrus, Tenneco Oil E&P Co. Cased-Hole Evaluation With the Chlorine Log, SPE 13141, Copyright 1984.

Wiltse, D.J., "Fishing Jobs Using Continuous Rod," Weatherford Artificial Lift System, Mar. 30, 1999, 1 page.

Pro-Rod, Coiled Rod Product Line, www.ctechenergy.com, Apr. 4, 2002.

UK Search Report, Application No. GB0526443.7, dated Mar. 30, 2006.

* cited by examiner

APPARATUS AND METHODS FOR OPERATING A TOOL IN A WELLBORE

CROSS-REFERENCE TO RELATED APPLICATIONS

This application is a continuation-in-part of U.S. patent application Ser. No. 10/127,021, filed Apr. 19, 2002, now U.S. Pat. No. 6,915,849 which claims benefit of U.S. provisional patent application Ser. No. 60/285,891, filed Apr. 23, 2001. This application is also a continuation-in-part of U.S. patent application Ser. No. 10/867,389, filed Jun. 14, 2004, now U.S. Pat No 7,185,700. This application is also a continuation-in-part of U.S. patent application Ser. No. 10/848,337, filed May 18, 2004, now U.S. Pat. No. 7,000,692 which claims benefit of U.S. Pat. No. 6,736,210, filed Feb. 6, 2001. This application is also a continuation-in-part of U.S. patent application Ser. No. 10/999,818, filed Nov. 30, 2004 (now abandoned), which claims benefit of U.S. Pat. No. 6,825,459, filed Sep. 10, 2001 which was a continuation-in-part of U.S. patent application Ser. No. 09/225,029, filed Jan. 4, 1999 (now abandoned). This application is also a continuation-in-part of U.S. patent application Ser. No. 10/068,555, filed Feb. 6, 2002(now abandoned). Each of the aforementioned related patent applications is herein incorporated by reference.

BACKGROUND OF THE INVENTION

1. Field of the Invention

The present invention generally relates to the operation of instrumentation within a wellbore. More particularly, the invention relates to an apparatus and a method for conveying and operating tools into a wellbore.

2. Description of the Related Art

In the drilling of oil and gas wells, a wellbore is formed using a drill bit that is urged downwardly at a lower end of a drill string. After drilling a predetermined depth, the drill string and the drill bit are removed, and the wellbore is lined with a string of steel pipe called casing. The casing provides support to the wellbore and facilitates the isolation of certain areas of the wellbore adjacent hydrocarbon bearing formations. An annular area is thus defined between the outside of the casing and the earth formation. This annular area is typically filled with cement to permanently set the casing in the wellbore and to facilitate the isolation of production zones and fluids at different depths within the wellbore. Numerous operations occur in the well before or after the casing is secured in the wellbore. Many operations require the insertion of some type of instrumentation or hardware within the wellbore. For instance, logging tools are employed in the wellbore to determine various formation or structural parameters including hydrocarbon saturation and cement bond integrity.

Early oil and gas wells were typically drilled in a vertical or near vertical direction with respect to the surface of the earth. As drilling technology improved and as economic and environmental demands required, an increasing number of wells were drilled at angles which deviated significantly from vertical. In the last several years, drilling horizontally within producing zones became popular as a means of increasing production by increasing the effective wellbore wall surface exposed to the producing formation. It is not uncommon to drill sections of wellbores horizontally (i.e. parallel to the surface of the earth) or even "up-hill" where sections of the wellbore were actually drilled toward the surface of the earth.

The advent of severely deviated wellbores introduced several problems in the performance of some wellbore operations. Conventional logging was especially impacted. Conventional logging utilizes the force of gravity to convey logging instrumentation into a wellbore. Gravity is not a suitable conveyance force in highly deviated, horizontal or up-hill sections of wellbores. Numerous methods have been used, with only limited success, to convey conventional instrumentation or "tools" in highly deviated conditions. These methods include the use of conveyance members such as electric wireline, slickline, coiled tubing, or jointed pipe.

Electric wireline or "wireline" is generally a multi-strand wire or cable for use in oil or gas wells. Wireline typically comprises at least a single conductor cable surrounded by a plurality of braided non-conductive cables. The non-conductive cables provide structural support for the single conductor cable during transport of the wireline into the wellbore. In a logging operation, a logging tool is attached to the wireline and then the tool string is either lowered into the wellbore utilizing the force of gravity or pulled into the wellbore by a tractor device. As discussed above, gravity is not a suitable conveyance force in highly deviated, horizontal, or up-hill sections of wellbores, and tractor devices are expensive and complex.

A slickline is generally a single-strand non-conductive wire with an outer diameter between 5/16" to 3/8". Due to the slickline's small diameter (particularly in relation to typical wellbore diameters) and hence minimal columnar buckling resistance, slickline cannot be pushed or urged into the wellbore, but rather slickline must rely on utilizing the force of gravity. For example, in a logging operation, a logging tool is attached to the slickline and then the tool string is lowered into the wellbore utilizing the force of gravity. As discussed above, gravity is not a suitable conveyance force in highly deviated, horizontal, or up-hill sections of wellbores. Both slickline and wireline are "impossible" to push for any appreciable distance in a wellbore. The old adage "like pushing a rope" indicating extremely difficult is applicable to attempts to deploy wireline or slickline by means of axial force applied from the surface (of the Earth). The structural component of wireline is typically braided cable. As such, wireline performs reasonably well under axial tension, but particularly poorly under axial compression. The buckling strength of wireline having a given apparent diameter is greatly diminished because the strands of cable comprising the wireline are capable of relative axial movement. Even slickline, which is typically single strand construction, has a fairly low buckling strength because of its small diameter (and therefore large length to diameter ratio when deployed).

Coiled tubing can be "pushed" into a wellbore more readily than wireline or slickline but still has limitations. Coiled tubing is a long continuous length of spooled or "reeled" thin walled pipe. Coiled tubing units utilize hydraulic injector heads that push the coiled tubing from the surface, allowing it to reach deeper than slickline, but ultimately the coiled tubing stops as well. Coiled tubing is susceptible to a condition known as lockup. As the coiled tubing goes through the injector head, it passes through a straightener; but the tubing retains some residual bending strain corresponding to the radius of the spool. That strain gives the tubing a helical form when deployed in a wellbore. Therefore it winds axially along the wall of the wellbore like a long, stretched spring. Ultimately, when a long enough length of coiled tubing is deployed in the well bore, frictional forces from the wellbore wall rubbing on the coiled tubing cause the tubing to bind and lock up, thereby stopping its progression. Such lock up limits the use of coiled tubing as a conveyance member for logging tools in highly deviated, horizontal, or up-hill sections of wellbores.

Another limitation of coiled tubing is the limited capability of pushing coiled tubing into the wellbore due to known structural characteristics of coiled tubing. Coiled tubing comes in a range of diameters and wall thicknesses. For instance, coiled tubing could have a 1" diameter with a wall thickness of 0.080" to approximately a 3.5" diameter with a wall thickness of 0.203". The ability of a pipe to withstand buckling under axial end loading is proportional to the pipe diameter and the pipe wall thickness as indicted by generally accepted equations for calculating column buckling. In the Eulerian equation below for buckling of cylindrical cross sections under axial end loading, the critical buckling load $P_{cr}$ is a function of material properties (properties of steel are most often applicable in the case of coiled tubing) and the outer and inner diameters of the cylindrical column (note: outer diameter minus inner diameter divided by two equals wall thickness).

$$P_{cr}=4\pi^3E(D^4-d^4)/64L^2$$

E=Youngs's Modulus for steel ($3\times10^7$)

D=outer diameter d=inner diameter

L=length

Further, the above equation illustrates that as the length of deployed tubing increases the load at which that tubing will buckle decreases. In a typical extended reach well (thousands of feet deep) readily coiled tubing buckles due to the friction loading between lower portions of the tubing and the walls of the wellbore. Once buckling occurs such frictional loading increases and ultimately exceeds the capacity of the surface equipment and/or the coiled tubing to sustain further loading. At that point, the coiled tubing has gone as far into the wellbore as it can go. Thus, the structural characteristics of coiled tubing limits the capability of using coiled tubing as a conveyance member for logging tools in highly deviated, horizontal, or up-hill sections of wellbores.

Further exacerbating the aforementioned buckling issue is the fact that coiled tubing is supplied from the manufacturer on a reel. For practical transportation and handling matters such reels have size (outer diameter) limits that are not to be exceeded. As such, coiled tubing is plastically deformed when reeled at the manufacturing mill because it must be made to fit on a given reel regardless of its cross-sectional diameter. The tubing is not only deformed axially by such installation on the reel, it is also deformed cross-sectionally such that it assumes a permanent ovality. Such "factory" ovality specifications are published by the various manufacturers of coiled tubing. The capability of employing coiled tubing in highly deviated, horizontal, or up-hill sections is therefore further limited due to the ovality of the coiled tubing because the ovality decreases the buckling resistance of the tubing. The ovality in conjunction with the residual axial strain (from being reeled) also causes the tubing to assume an inherent helical profile when deployed in a wellbore and therefore at even relatively small axial compression loads the tubing winds helically against the wall of the well bore thereby increasing its frictional engagement of that wall. Ovality also decreases the ability of the tube to resist collapse under external differential pressure. Thus, the ovality limits of coiled tubing also limits the capability of using coiled tubing as a conveyance member for logging tools in highly deviated, horizontal, or up-hill sections of wellbores.

Jointed pipe has been used for the deployment of certain downhole devices even where "pushing" is required. In a given diameter range jointed pipe has greater buckling resistance than any of wireline, slickline, or coiled tubing. Each threaded connection (typically every thirty feet) in a string of jointed pipe acts as a column stiffener and upset threaded connections also tend to stand the bulk of the pipe away from the wall of the wellbore thereby reducing cumulative frictional engagement. Jointed pipe is deficient in that it requires a rig (including some form of derrick or crane) for deployment and deployment is very time consuming. Each threaded connection must be made and unmade when correspondingly deploying or retrieving jointed pipe. The additional time consumption and the logistics of moving a rig onto a work location make the use of jointed pipe very expensive as compared with reeled deployment options such as wireline, slickline, and coiled tubing.

A need therefore exists for a reliable and operationally efficient apparatus and method to convey and operate a wellbore tool, such as a logging tool, in a wellbore which is deviated from the vertical.

SUMMARY OF THE INVENTION

One embodiment generally relates to an apparatus and a method for conveying and operating tools into a wellbore. In one aspect, a method of performing a downhole operation in a wellbore is provided. The method includes pushing a continuous rod into the wellbore, wherein the continuous rod includes a communication member disposed therein. The method further includes positioning the continuous rod proximate a predetermined location in the wellbore and performing the downhole operation.

In another aspect, a method of performing a downhole operation in a wellbore is provided. The method includes pushing a continuous rod into the wellbore, wherein the continuous rod includes a small bore disposed therein. Optionally the small bore may be coated with a material. The method further includes positioning the continuous rod proximate a predetermined location in the wellbore and transmitting a signal through the small bore.

In further aspect, a method of performing a downhole operation in a deviated wellbore is provided. The method includes pushing a continuous rod into the deviated wellbore. The method further includes positioning the continuous rod proximate a predetermined location in the deviated wellbore and transmitting a signal.

In yet another aspect, a system for performing a downhole operation in a wellbore is provided. The system includes a continuous rod having a data communication member operatively attached thereto. The system further includes a delivery apparatus for pushing the continuous rod into the wellbore, wherein the delivery apparatus includes a depth encoder for tracking the amount of continuous rod pushed into the wellbore. Additionally, the system includes a member having circuitry for receiving and analyzing data from the data communication member and the depth encoder.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Typically, a continuous sucker rod or COROD string is made from a round cross section solid or near solid rod having for example at least a ⅝" outer diameter. While the outer diameter dimensions may vary, the relatively small diameter to thickness ratios of COROD is distinctive. For solid cross section COROD the diameter to thickness ratio can be stated as equaling 2 (taking thickness from the cross section centerline). For COROD with a small inner diameter such as ⅛" and an outer diameter of 1⅛" the diameter to thickness ratio could be stated as equaling 2.25. If the inner diameter of such a 1⅛" COROD were larger than ⅛" the diameter to thickness ratio would increase correspondingly. The diameter to thickness ratios for COROD is however significantly less than those for coiled tubing for which the ratios are typically 15 and higher. Unlike a jointed sucker rod which is made in specific lengths and threaded at each end for sequential connection of those lengths, COROD is made in one continuous length and placed on a reel. Because COROD has fairly low diameter to thickness ratios (often equaling 2 as previously discussed), such reeling does not impart any significant ovality to the COROD. Further the COROD diameter in relation to the diameter or apparent diameter of the reel is such that residual bending strain in the COROD is minimized or eliminated. As such the COROD retains its buckling resistance characteristics when deployed into a wellbore. Unlike wireline or slickline, COROD can be "pushed" into a wellbore and unlike coiled tubing it can be pushed further because it doesn't tend to helix within the wellbore. Also, because COROD has material across a substantial portion of its cross section it retains relatively high tensile and compressive strength under axial loading as well as internal or external differential pressure. COROD is superior to jointed pipe because it can be deployed using a more cost effective and logistically versatile system and in a more time efficient manner.

The COROD string works equally well in vertical and highly deviated wells. The COROD can be used for multiple runs into a well or wells with no fatigue because unlike coiled tubing it is not plastically deformed when cycled on and off the reel. The COROD string can be run through tubing thereby eliminating the additional cost and time required to deploy a jointed pipe, or tractor conveyed systems. It is also noteworthy that the COROD string for conveying equipment is not limited to oil and gas well applications. It is equally applicable to use in a pipeline where pipeline inspection services are run. To better understand the novelty of the apparatus of the present invention and the methods of use thereof, reference is hereafter made to the accompanying drawings.

Figure 1:
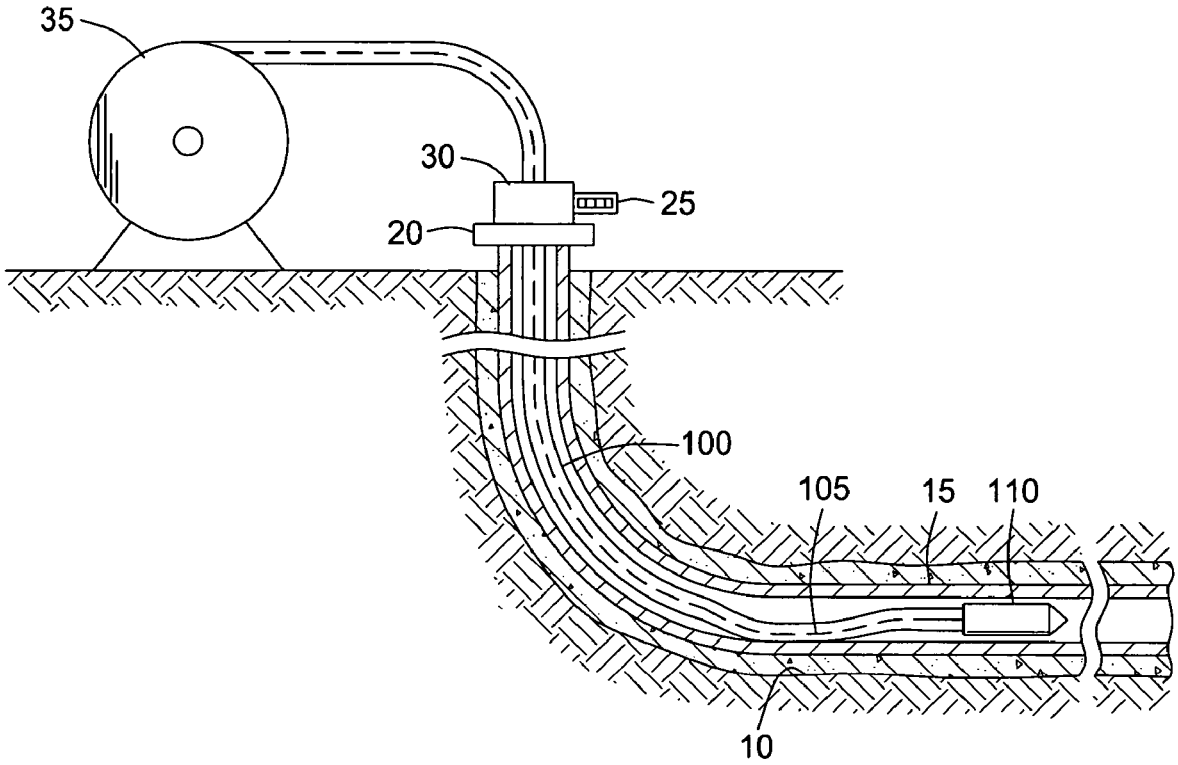
FIG. 1 is a sectional view illustrating a continuous sucker rod ("COROD"®) string positioned in a wellbore, wherein the COROD string includes a signal transmission line disposed therein.

FIG. 1 is a sectional view illustrating a COROD string 100 positioned in a wellbore 10. As shown, the wellbore 10 is lined with a string of casing 15. The casing 15 provides support to the wellbore 10 and facilitates the isolation of certain areas of the wellbore adjacent hydrocarbon bearing formations. For purposes of discussion, the wellbore 10 is illustrated as a deviated wellbore. It should be understood, however, that the COROD string 100 may be employed in a vertical wellbore without departing from principles of the present invention.

Generally, the COROD string 100 is positioned at the wellsite on a rotatable storage reel 35. Next, an end of the COROD string 100 is inserted into a delivery apparatus 30 that is affixed to a wellhead 20. The delivery apparatus 30 provides the force required to insert the COROD string 100 into the wellbore 10 and to withdraw the COROD string 100 out of the wellbore 10. Preferably, the delivery apparatus 30 includes a depth encoder 25 to record the amount of COROD string 100 within the wellbore 10 at any given time thereby determining the position of a tool 110 within the wellbore 10. For example, when the COROD string 100 is used in a logging operation, the downhole tool 110 records data of interest in a memory module within the downhole tool 110. Data is subsequently retrieved from the memory module when the tool 110 is withdrawn from the wellbore 10. Optionally such data can be transmitted in real time using embodiments of COROD comprising signal transmission paths. Data measured and recorded by the downhole tool 110 is then correlated with the depth encoder reading thereby defining the position of the tool 110 in the wellbore 10. This information is then used to form a "log" of measured data as a function of depth within the wellbore 10 at which the data is recorded.

The delivery apparatus 30 may include circuitry for receiving and analyzing data. Alternatively, a surface acquisition member (not shown) or a data acquisition member (not shown) may be employed to provide the circuitry for receiving and analyzing data.

The foregoing apparatus and its methods of use are equally useful with a variety of conveyance members including solid, continuous rod, coiled tubing, jointed pipe and slickline.

Figure 1A:
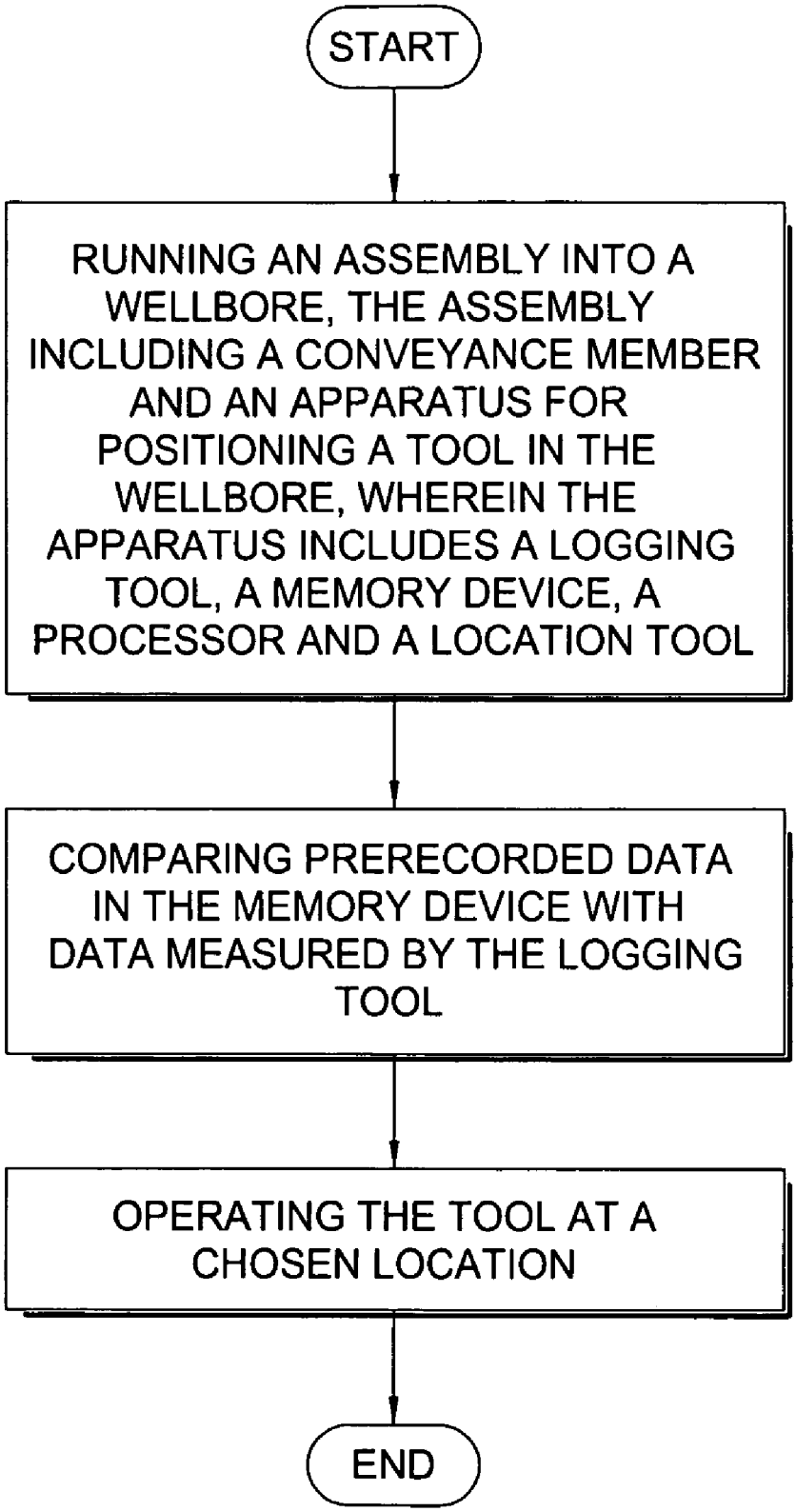
FIG. 1A is one embodiment that illustrates steps of operating a tool in a wellbore.

Additionally, the memory module may include a processor. As shown in FIG. 1A, previously generated log data may be entered into the memory and the processor may generate a signal or actuate a tool carried by a conveyance member in response to arriving at a predetermined location in the wellbore. Such a predetermined location can be identified by logging the well while running and comparing that real time data to the previously generated data to verify arrival at the predetermined location. It should be noted that the conveyance member could be any conveyance member known in the art, such as a continuous reelable rod (COROD), jointed pipe, coiled tubing or slickline. The general use of real time data for placement of downhole tools is shown in U.S. Publication No. U.S. 2002/0104653, which is incorporated herein by reference.

Referring back to FIG. 1, the COROD string 100 includes a fiber line 105. Preferably, the fiber line 105 is coaxially disposed within the COROD string 100. In one embodiment, the fiber line 105 may be used to transmit signals to a downhole apparatus to effect the operation thereof. For instance, the tool 110 may have a valve arrangement. A signal from the surface of the wellbore 10 may be transmitted through the fiber line 105 in the COROD string 100 and processed by a controller to actuate the valve arrangement of the tool 110. It is contemplated that other forms of types of tools may be employed without departing from the aspects of the present invention.

In another embodiment, the tool 110 may be a sensor that is designed to provide real time data regarding wellbore parameters such as pressure, temperature, strain, and/or other monitored parameters. Generally, perturbations in these parameters induce a phase shift in the optical signal, which is received from the tool 110 by a receiver (not shown). When the receiver receives the signal, the phase shift is detected. The phase shift is processed using interferometric techniques such as Mach-Zehnder, Michelson, Fabry-Perot, and Sagnac.

In a further embodiment, the tool 110 may include multiple optical sensors arranged in a network or array configuration with individual sensors multiplexed using time division multiplexing or frequency division multiplexing. The network of sensors may provide an increased spatial resolution of temperature, pressure, strain, or flow data in the wellbore 10. One form of sensor networks is known as distributed sensing. Distributed sensor schemes typically include Bragg grating sensors and optical time domain reflectometry ("OTDR"). For example, Bragg grating sensors may be formed in one or more positions along the length of the fiber line 105. These sensors provide real time data at each of these positions, which can be processed to give a clearer picture of the conditions along the length of the wellbore 10. In another example, Raman OTDR may be used to collect temperature data to provide a temperature gradient inside the wellbore 10. It is contemplated that other schemes of optical sensors 100 may be used without departing from the aspects of the present invention.

Figure 2:
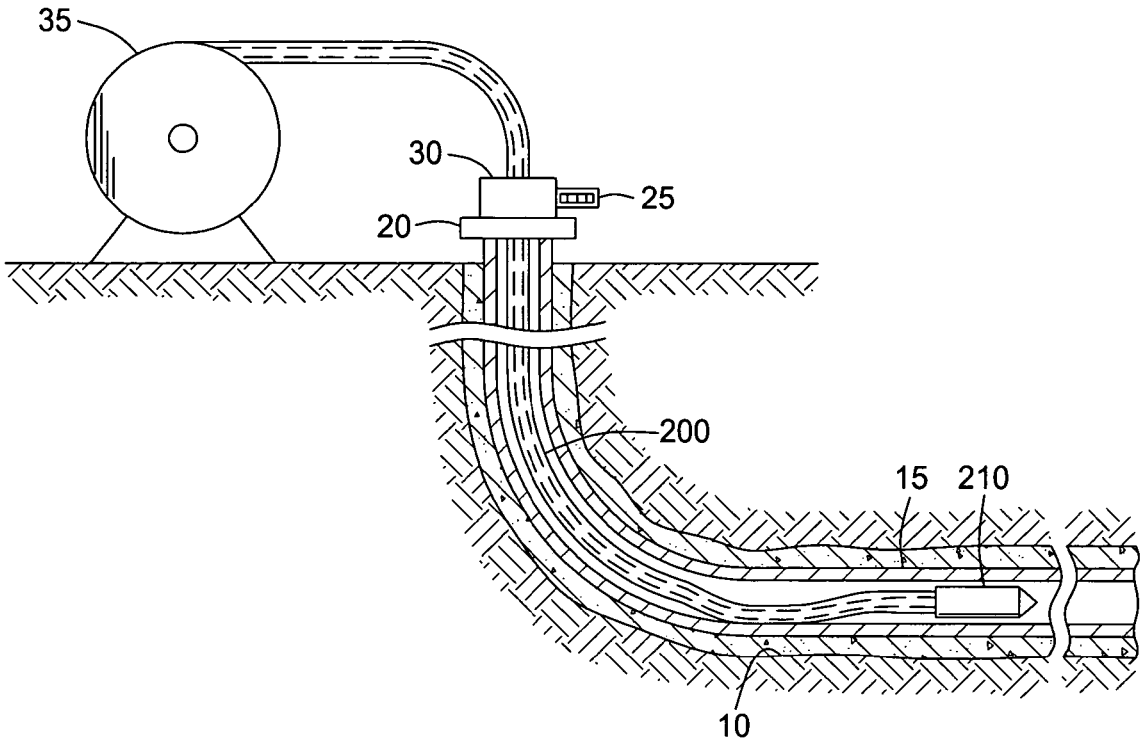
FIG. 2 is a sectional view illustrating a COROD string positioned in the wellbore, wherein the COROD string includes a member coaxially disposed therein.

FIG. 2 is a sectional view illustrating a COROD string 200 positioned in the wellbore 10, wherein the COROD string 200 includes a member 205 coaxially disposed therein. It should also be noted that member 205 has a small diameter relative to the diameter of the COROD string 200 and therefore the strength of the COROD string 200 is not substantially affected. For convenience, components in FIG. 2 that are similar to the components in FIG. 1 will be labeled with the same number indicator.

In one embodiment, the member 205 is a capillary tube coaxially disposed within the COROD string 200. The capillary tube may be employed for injecting chemicals to an area of interest in the wellbore 10. In this embodiment, the COROD string 200 is positioned proximate an area of interest to be chemically treated. Next, a chemical injector (not shown) at the surface of the wellbore 10 is attached to the capillary tube in the COROD string 200. Thereafter, the chemical injector urges a chemical through the capillary tube to the area of interest. If required, the COROD string 200 may be moved to another area of interest and the injection process may then be repeated as many times as necessary.

In another embodiment, the capillary tube (member 205) may also be used for pressure measurement. In this embodiment, the COROD string 200 is positioned at a predetermined location in the wellbore 10. Next, a pressure gage (not shown) is connected to the capillary tube to measure the pressure at the predetermined location. The COROD string 200 could then be moved to another location and then another pressure measurement could be taken. Thereafter, the pressure measurement data could be correlated with the depth encoder reading thereby defining the pressure at various locations in the wellbore 10. This information is then used to form a "log" of measured data as a function of depth within the wellbore 10 at which the data was recorded.

In a further embodiment, the capillary tube (member 205) may be used to actuate a tool 210 at the lower end of the COROD string 200. In this embodiment, the COROD string 200 is urged into the wellbore 10 to position the tool 210 proximate a predetermined point. Next, a signal, such as a pressure signal or a pulse signal, may be transmitted from the surface of the wellbore 10 through the capillary tube to the tool 210. Thereafter, the signal may be processed by a downhole controller (not shown) or may otherwise physically act upon a portion of the tool to actuate tool 210.

In another embodiment, the member 205 is a conductor cable capable of transmitting electrical power for use in performing various down hole operations, such as welding or melting paraffin. In this embodiment, the COROD string 200 is positioned in the wellbore 10 proximate an area of interest. Next, the conductor cable in the COROD string 200 is attached to an electrical generation apparatus (not shown) at the surface of the wellbore 10. Thereafter, an electrical power generated by the apparatus is transmitted through the conductor cable in the COROD string 200 to the area of interest to perform a downhole operation. The conductor cable may be surrounded by an insulating layer within the COROD or the COROD may be insulated about its exterior.

Figure 3:
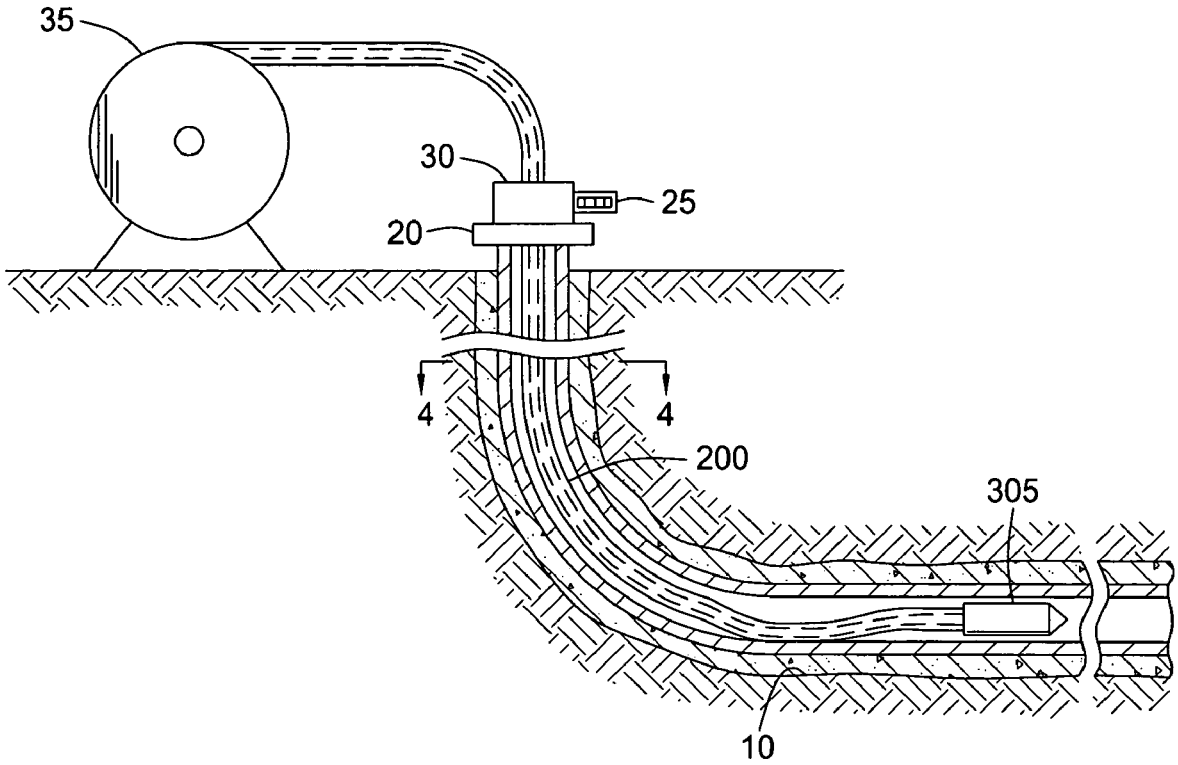
FIG. 3 is a sectional view illustrating a COROD string positioned in the wellbore, wherein the COROD string includes a small bore coaxially disposed therein.
Figure 4:
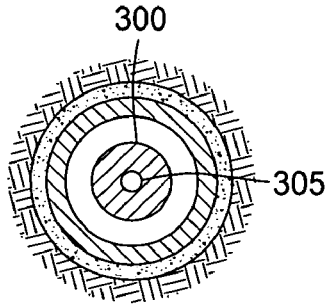
FIG. 4 is a cross-section view taken along lines 4-4 in FIG. 3.

FIG. 3 is a sectional view illustrating a COROD string 300 positioned in the wellbore 10, wherein the COROD string 300 includes a small bore 305. For convenience, components in FIG. 3 that are similar to the components in FIG. 1 will be labeled with the same number indicator. As shown in FIG. 4, the bore 305 may be coaxially disposed within the COROD string 300 and the bore has a small diameter relative to the diameter of the COROD string 300 and therefore the strength of the COROD string 300 is not substantially affected. In one embodiment, the bore 305 has a ¼" diameter.

In another embodiment, the small bore 305 is coated with a low dielectric material, such as plastic (i.e. polymer), that is used to transmit microwave signals or other electromagnetic waveform signals up and down the COROD string 300 and to provide real time data. In this embodiment, the COROD string 300 is positioned in the wellbore 10. Next, a microwave signal is generated and transmitted through the bore 305 of the COROD string 300. Thereafter, a microwave receiver (not shown) positioned proximate the wellbore 10 receives the microwave signal and records data. After the data is collected, the data may be correlated with the depth encoder reading thereby defining the data points at various locations in the wellbore 10. This information is then used to form a "log" of measured data as a function of depth within the wellbore 10 at which the data was recorded.

In another embodiment, the small bore 305 is coated with a reflective material that is used to transmit light signals up and down the COROD string 300 and to provide real time data. In this embodiment, the COROD string 300 is positioned in the wellbore 10. Next, a light signal is generated and transmitted through the bore 305 of the COROD string 300. Thereafter, a receiver (not shown) positioned proximate the wellbore 10 receives the light signal and records data. After the data is collected, the data may be correlated with the depth encoder reading thereby defining the data points at various locations in the wellbore 10. This information is then used to form a "log" of measured data as a function of depth within the wellbore 10 at which the data was recorded.

Figure 5:
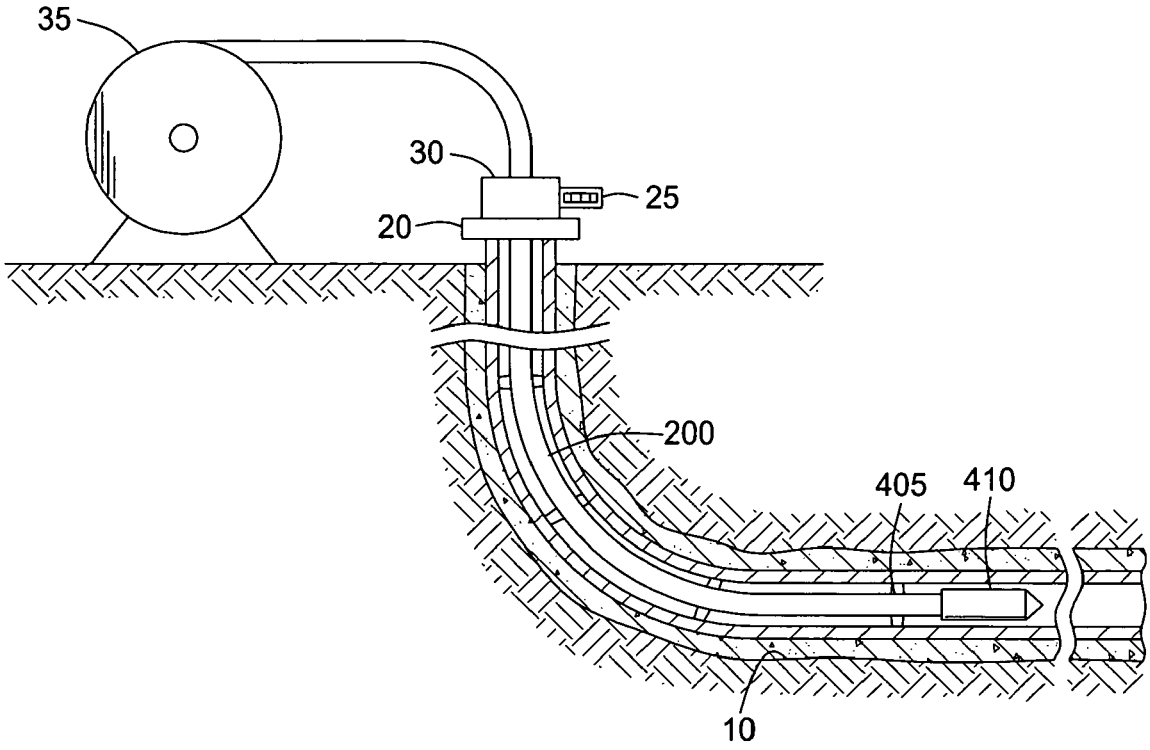
FIG. 5 is a sectional view illustrating a solid COROD string positioned in the wellbore.

FIG. 5 is a sectional view illustrating a solid COROD string 400 positioned in the wellbore 10. For convenience, components in FIG. 5 that are similar to the components in FIG. 1 will be labeled with the same number indicator. In one embodiment, the COROD string 400 includes a plurality of centralizers 405. Each centralizer 405 is a mechanical device that is used to position the COROD string 400 concentrically in the wellbore 10. More specifically, the centralizer 405 is used to provide a constant annular space around the COROD string 400, rather than having the COROD string 400 lying eccentrically against the wellbore 10. For straight holes, bow spring centralizers are sufficient and commonly used. For deviated wellbores, where gravitational force pulls casing to the low side of the hole, more robust solid or solid-bladed centralizers are typically used. Optionally the centralizers may be constructed of an acoustic insulating material. In other embodiments the centralizers or stabilizers may have other insulating properties as needed (e.g. electrically insulating).

In this embodiment, the COROD string 400 is lowered into the wellbore 10 to a predetermined depth. Thereafter, an acoustic signal is generated at the surface of the wellbore 10 and transmitted through the COROD string 400. The acoustic signal is used to perform a downhole operation, such as actuation of a downhole tool 410. As shown in FIG. 5, the centralizers 405 concentrically position the COROD string 400 in the wellbore 10. This arrangement substantially insulates the COROD string 400 from the wellbore 10 and minimizes the dampening effects due to wellbore contact and thereby allowing the acoustic signal to pass through the COROD string 400 to perform the downhole operation. It is understood that such acoustic transmission can also be generated downhole and transmitted to the surface or to another location in the wellbore.

In another embodiment, the outer diameter of the COROD string 400 may be coated with an acoustic insulator to facilitate signal transfer by reducing the dampening effects due to contact with the sides of the wellbore 10. In this embodiment, the COROD string 400 is lowered into the wellbore 10 to a predetermined depth. Thereafter, an acoustic signal is generated at the surface of the wellbore 10 and transmitted through the COROD string 400 to perform a downhole operation, such as actuation of the downhole tool 410. To further minimize the dampening effects of the acoustic signal due to contact between the COROD string 400 and the sides of the wellbore 10, the acoustic insulator coating may be used in conjunction with the centralizers 405. It is understood that such acoustic transmission can also be generated downhole and transmitted to the surface or to another location in the wellbore. The same is true of any signal transmission mechanism that may be used in conjunction with or that comprises COROD.

In another embodiment, the COROD string 400 could be used as a data conductor by coating the outer diameter with an insulator. In this embodiment, the COROD string 400 could be lowered to a predetermined location in the wellbore 10. Thereafter, a data signal could be generated at the surface of the wellbore and transmitted downhole via the insulated COROD string 400 to perform a downhole operation, such as actuation of a downhole tool or measurement of a downhole parameter. Alternatively, a data signal could be generated downhole and transmitted to the surface via the insulated COROD string 400. In either case, the data could be collected and correlated with the depth encoder reading thereby defining the data points at various locations in the wellbore 10. This information is then used to form a "log" of measured data as a function of depth within the wellbore 10 at which the data was recorded. Such a data signal or power signal may be electromagnetic, acoustic or any other type that would benefit from an insulating layer as described.

In a further embodiment, the COROD string 400 includes a cross-section (not shown) with a first transmission path and a second transmission path. The paths may be coated with a material that allows the COROD string 400 to transmit signals, such as a microwave signal or a light signal. Alternatively, the paths may be used for performing a downhole operation, such as chemical injection, pressure measurement, or tool actuation. One or both of the paths may be located eccentrically within the cross-section of the COROD. Optionally the COROD may comprise more than two paths and further it may comprise a variety such as one or more electrically conductive paths in conjunction with one or more fluid, optical, or acoustic paths.

Figure 6:
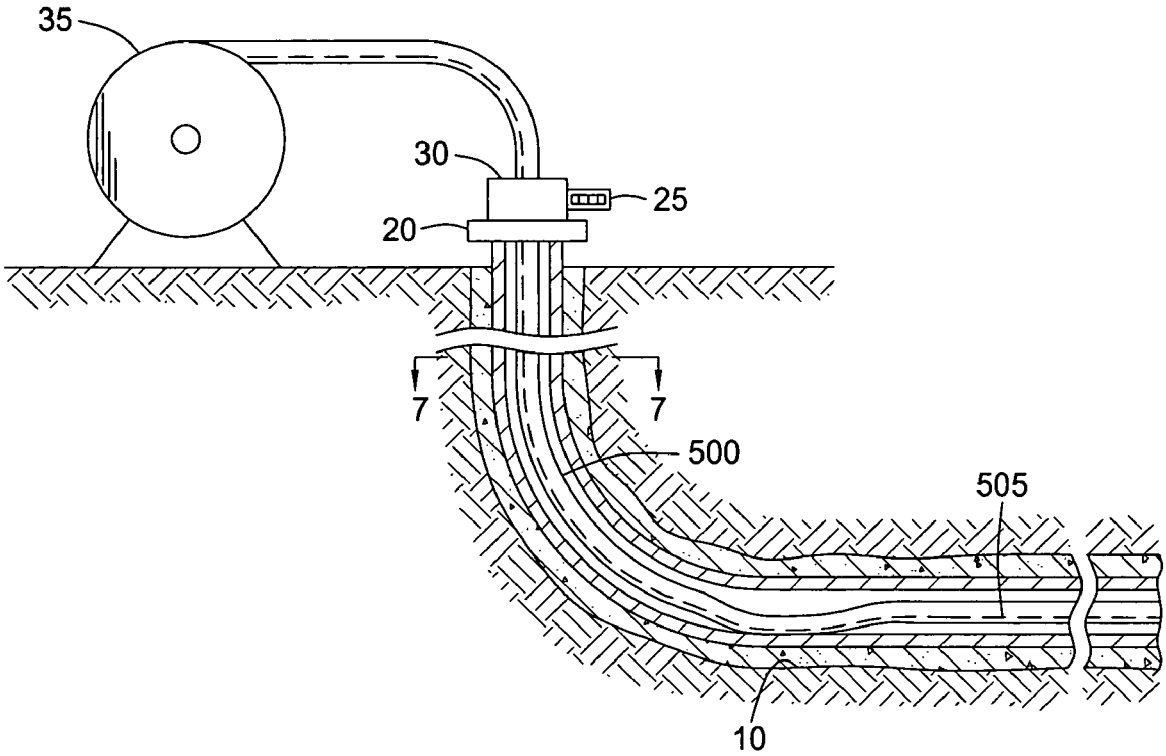
FIG. 6 is a sectional view illustrating a COROD string positioned in the wellbore, wherein the COROD string includes a slot for housing a cable.

FIG. 6 is a sectional view illustrating a COROD string 500 positioned in the wellbore 10, wherein the COROD string 500 includes a slot 505 for housing a cable 510 or other suitable transmission members. For convenience, components in FIG. 6 that are similar to the components in FIG. 1 will be labeled with the same number indicator.

Figure 7:
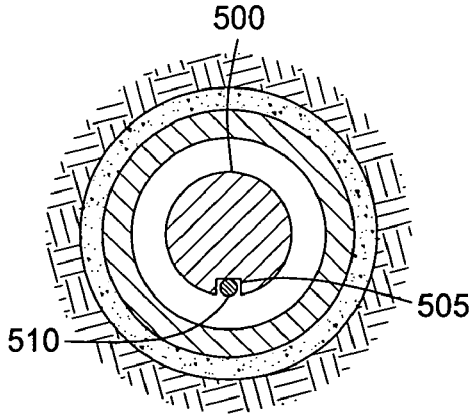
FIG. 7 is a cross-section view taken along lines 7-7 in FIG. 6.

As shown in FIG. 7, the COROD string 500 includes the slot 505 formed on an outer surface thereof. The slot 505 is substantially continuous the entire length of the COROD string 500. The slot 505 is constructed and arranged to house the cable 510 within the COROD string 500. The cable 510 may be secured in the slot 505 by any connection means known in the art, such as a plurality of connection members, glue, or a sheath surrounding the COROD. Typically, the cable 510 is placed in the slot 505 prior to placing the COROD string 500 into the wellbore 10. The cable 510 may be used to perform a downhole operation in a similar manner as discussed herein. Alternatively, a capillary tube could be positioned in the slot 505, wherein the capillary tube can be used to perform a downhole operation in a similar manner as discussed herein.

Figure 8:
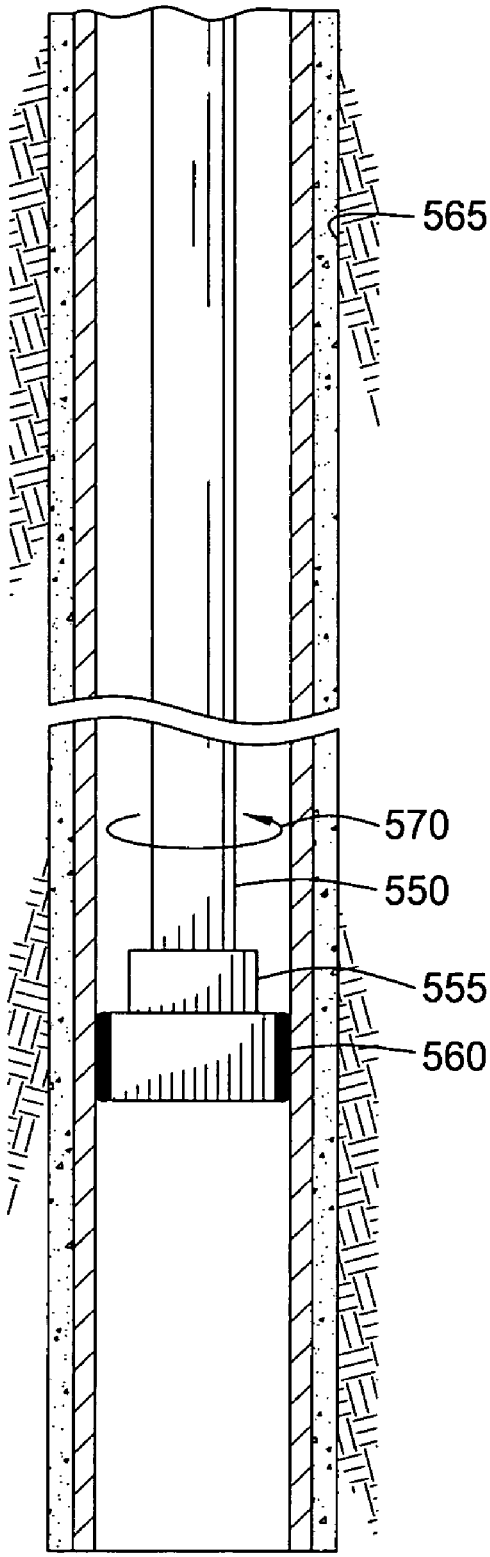
FIG. 8 is a sectional view illustrating a COROD string with a pump system.
Figure 9:
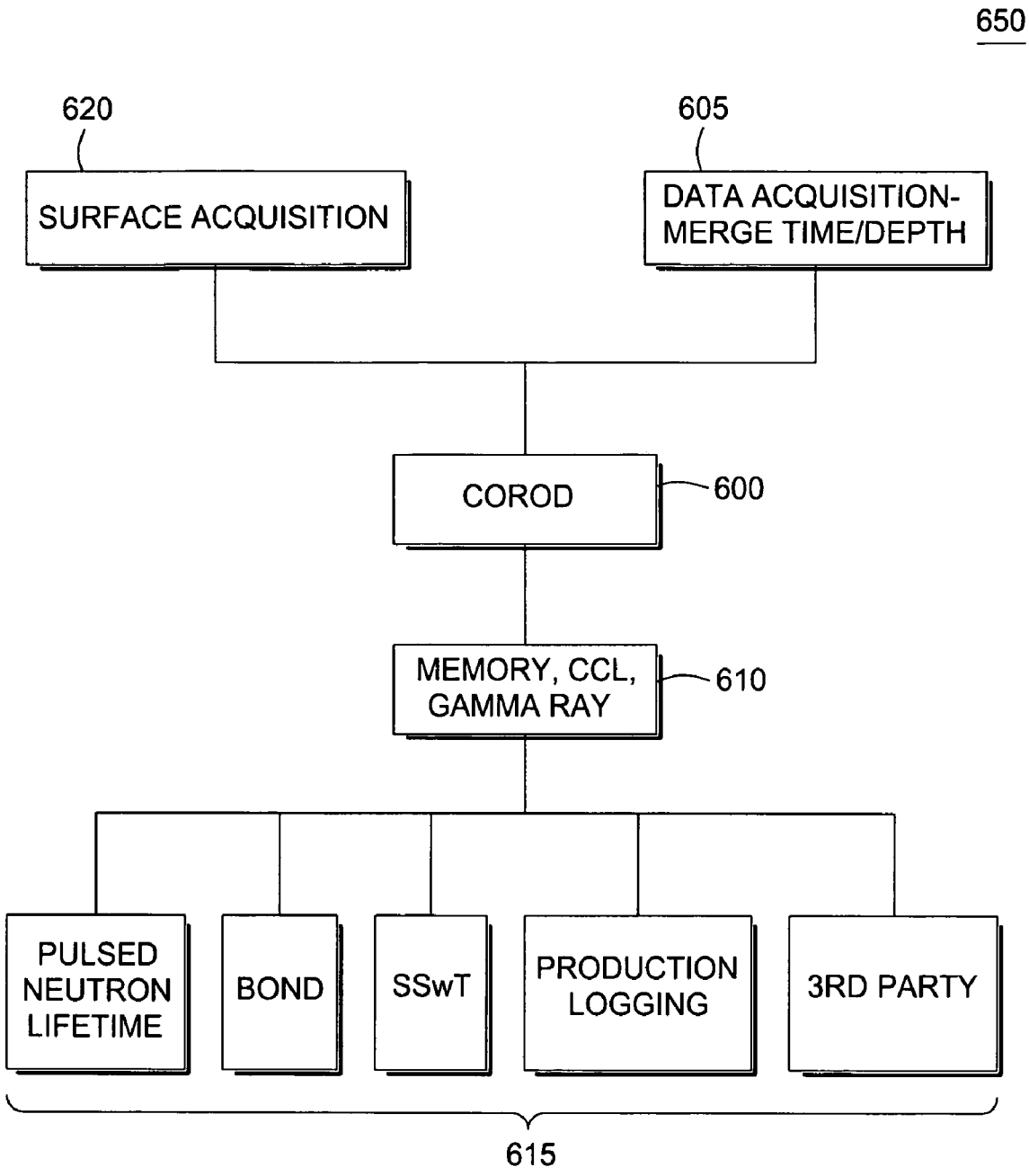
FIG. 9 is a block diagram of a logging system for use with a COROD string.

In another embodiment, the COROD string of the present invention may also be used in other types of wellbore operations. For example, as shown in FIG. 8, a COROD string 550 may be used to deploy a rod driven pump system 555 in a wellbore 565, locate the pump system 555, activate an anchor mechanism 560 of the pump system 555, and then drive the pump system 555 by transmitting rotational energy from the surface as indicated by arrow 570. Alternatively, the pump system 555 may be driven by transmitting electrical, optical, hydraulic or reciprocating energy from the surface or combinations thereof. In the case of physical rotation or reciprocation, a solid rod may be used. Alternatively, a tubular rod could have a conductor therein.

The COROD could be further used to then monitor one or all of pumping parameters, formation parameters, or production parameters and optionally to transmit data back to the surface to facilitate control of the pumping operation. Such a pump system may include an electric submersible, progressing cavity, or reciprocating rod type pump or other suitable pump. Such a system may further include packers and other downhole flow control devices. Further, the COROD string could be constructed and arranged for use in fishing services due to the high push/pull capability of the COROD string. In another example, the COROD string may be constructed and arranged for use in completion operations, such as placing a flat pack in the wellbore, wherein the flat pack includes hydraulic and electrical umbilicals. In yet another example, the COROD string may be used to locate a casing exit window by deploying a logging device and using original survey data either transmitted via the COROD or contained within a memory module attached thereto. Additionally, the COROD string may be used to position or orient tools in the wellbore and the COROD string may be used with a multifinger imaging tool (MIT) to evaluate dynamic flow conditions and borehole profile on a horizontal well. In another example, the COROD string may be used with a production logging tool (PLT) comprising a capacitor array tool, a quartz pressure gauge, a temperature tool, a fullbore spinner flowmeter tool, a fluid density tool, a gama ray tool and an accelerometer to measure hole deviation. The PLT may be used with the multifinger imaging tool As discussed above, the storage reel 35 is used with the delivery apparatus 30 to position the COROD string in the wellbore 10. The storage reel 35 is also used to transport the COROD string to the wellsite. Typically, the storage reel 35 has a circular shape and is placed vertically on a trailer bed (not shown) for transport to the wellsite. However, as the depth of the wellbore increases so must the length of the COROD string. In turn, the diameter of the storage reel 35 also becomes larger. In order, to transport a larger diameter storage reel 35 to the wellsite, the storage reel 35 may be placed on the trailer bed at an angle, such as 45 degrees. Alternatively, the storage reel 35 may be formed in an elliptical shape with the minor axis in a vertical position or an angled position on the trailer bed. At the wellsite, the elliptical shaped storage reel may be transformed in a circular shape by means well known in the art, such as hydraulics. In another arrangement, the storage reel 35 may be folded such as in a "U" shape or "taco" shape and then placed on the trailer bed for transport. At the wellsite, the storage reel 35 may be unfolded and subsequently used with the delivery apparatus 30 to position the COROD string in the wellbore 10.

FIG. 8 is a block diagram of a logging system 650 for use with a COROD string 600 in accordance with the present invention. The COROD string 600 is used for transporting a downhole tool 615 into a wellbore. The downhole tool 615 is connected to a memory module 610.

The memory module 610 may be used with the COROD string 600 in any configuration described herein. Depending on the configuration of the COROD string 600, the system 650 may include data acquisition member 605 or a surface acquisition member 620. For instance, if the COROD string 600 is configured to transmit real time data, then the surface acquisition member 620 will be used and a memory module 610 will act as a log backup. On the other hand, if the COROD string 600 is configured not to transmit real time data, then the data acquisition member 605 will be used and the memory module 610 will act as a data collector. After the data is collected, then the data acquisition member 605 may be used to correlate data from the depth encoder reading and the memory module 610 to define data points at various locations in the wellbore. This information is then used to form a "log" of measured data as a function of depth within the wellbore at which the data was recorded. In this respect, the arrangement of the memory module 610 standardizes the use of the tool 615, wherein the tool 615 is capable of working with either the data acquisition member 605 when no real time data is transmitted from downhole or the surface acquisition member 620 when real time data is transmitted from downhole. The arrangement of the memory module 610 also allows the tool 615 the capability of working with other types of conveyance members such as wireline, slickline, coiled tubing, or other types of tools such as digital telemetry tools.

The tool 615 may be any combination of downhole tools, without departing from principles of the present invention. For instance, the tool 615 may include a pulsed neutron lifetime logging tool which is used to identify prospective hydrocarbon zones by measuring neutron capture cross-section of the formation. The tool 615 may also include a spectral saturation tool for use in identifying prospective hydrocarbon zones by comparing hydrogen and chlorine in the formation and for use to determine water saturation of a zone. The tool 615 may also include an SSwT™ pulse neutron tool and capacitance array tools and other production logging tools.

While the foregoing is directed to embodiments of the present invention, other and further embodiments of the invention may be devised without departing from the basic scope thereof, and the scope thereof is determined by the claims that follow.

The invention claimed is:

1. A method of operating a tool in a wellbore, the method comprising:

placing the tool on a continuous conveyance member having a solid cross-section, wherein the continuous conveyance member is made from a metal material;

pushing the tool into the wellbore via the continuous conveyance member such that the tool is positioned at a location in the wellbore; and operating the tool.

2. The method of claim 1, wherein the tool is operated with a signal sent via the conveyance member.

3. The method of claim 1, further including fixing the tool at the location.

4. The method of claim 3, wherein the tool is configured to pump fluid.

5. The method of claim 4, wherein the tool is operated by supplying energy via the continuous conveyance member.

6. The method of claim 1, further including determining a depth of the tool in the wellbore by utilizing a depth encoder at the surface of the wellbore.

7. The method of claim 1, further including sending a signal from the tool to a surface of the wellbore.

8. The method of claim 1, further including memorizing data generated in the wellbore by utilizing the tool.

9. The method of claim 8, wherein the tool is a logging tool.

10. The method of claim 1, wherein the tool is pushed through a deviated portion of the wellbore with the conveyance member.

11. The method of claim 1, wherein the conveyance member is reeled from a reel into the wellbore.

12. The method of claim 1, wherein the conveyance member comprises a signal carrying path.

13. The method of claim 12, wherein the signal carrying path is solid.

14. The method of claim 1, wherein the solid cross-section comprises a signal carrying path.

15. The method of claim 1, wherein the tool is urged through a nonvertical portion of the wellbore with the conveyance member.

16. The method of claim 1, wherein the conveyance member extends from a surface of the wellbore to a point proximate the tool.

17. The method of claim 4, wherein the tool is operated by reciprocating the continuous conveyance member.

18. The method of claim 4, wherein the tool is operated by applying an axial force via the continuous conveyance member.

19. The method of claim 1, wherein the conveyance member is pushed from a surface of the wellbore.

20. The method of claim 1, wherein an acoustic signal is sent to the tool via the conveyance member.

21. The method of claim 1, wherein a slot is formed on an outer surface of the conveyance member.

22. The method of claim 21, wherein the slot is formed on substantially the entire length of the conveyance member.

23. The method of claim 1, wherein data generated by the tool is transmitted to the surface via the conveyance member.

24. The method of claim 1, wherein the conveyance member comprises a first transmission path and a second transmission path.

25. The method of claim 24, wherein a data signal is transmitted via the first transmission path.

26. The method of claim 1, wherein the tool comprises a memory module configured as a data backup.

27. The method of claim 21, wherein a capillary tube is positioned in the slot and the capillary tube is a transmission member.

28. A method of operating a tool in a wellbore, the method comprising:

placing the tool on a metal continuous rod having a solid cross-section;

pushing the tool into the wellbore via the metal continuous rod such that the tool is positioned at a location in the wellbore;

transmitting a data signal via the metal continuous rod; and operating the tool.

29. The method of claim 28, wherein the metal continuous rod extends from a surface of the wellbore to a point proximate the tool.

30. The method of claim 28, wherein the metal continuous rod is pushed from a surface of the wellbore.

31. The method of claim 28, wherein the data signal is generated by the tool in the wellbore.

32. The method of claim 28, wherein the tool comprises a memory module configured as a data backup.

33. The method of claim 28, wherein the metal continuous rod comprises a first transmission path and a second transmission path.

34. The method of claim 28, wherein the data signal is an acoustic signal.

35. The method of claim 34, wherein a portion of the metal continuous rod includes an acoustic insulator.

* * * * *